US008410408B2

(12) United States Patent
Kanou et al.

(10) Patent No.: US 8,410,408 B2
(45) Date of Patent: Apr. 2, 2013

(54) INDUCTION HEATING UNIT, FIXING DEVICE AND METHOD FOR ATTACHING COIL FOR INDUCTION HEATING UNIT

(75) Inventors: Hirotaka Kanou, Toyokawa (JP); Noboru Yonekawa, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 1527 days.

(21) Appl. No.: 11/785,724

(22) Filed: Apr. 19, 2007

(65) Prior Publication Data

US 2008/0149621 A1 Jun. 26, 2008

(30) Foreign Application Priority Data

Nov. 30, 2006 (JP) ..... 2006-324148

(51) Int. Cl.
*H05B 6/14* (2006.01)
*H05B 6/36* (2006.01)
*G03G 15/20* (2006.01)

(52) U.S. Cl. ..... 219/619; 219/672; 399/329; 399/330

(58) Field of Classification Search ..... 219/619, 219/674, 676, 216, 652, 672, 673; 399/90, 399/328–335, 337
See application file for complete search history.

(56) References Cited

U.S. PATENT DOCUMENTS

| | | | | |
|---|---|---|---|---|
| 4,799,310 | A | 1/1989 | Isobe et al. | |
| 6,320,168 | B1 | 11/2001 | Kimata et al. | |
| 7,005,619 | B2 | 2/2006 | Fujii et al. | |
| 7,383,010 | B2 | 6/2008 | Isayama et al. | |
| 2002/0051663 | A1* | 5/2002 | Kinouchi et al. | 399/330 |
| 2005/0067408 | A1* | 3/2005 | Fujii et al. | 219/619 |
| 2005/0199613 | A1* | 9/2005 | Samei et al. | 219/619 |
| 2006/0138126 | A1 | 6/2006 | Watanabe | |
| 2006/0147221 | A1 | 7/2006 | Asakura et al. | |

FOREIGN PATENT DOCUMENTS

| | | |
|---|---|---|
| JP | 07-130555 | 5/1995 |
| JP | 2000-215972 | 8/2000 |

(Continued)

OTHER PUBLICATIONS

Decision of Refusal issued in the corresponding Japanese Patent Application No. 2006-324148 dated Feb. 9, 2010, and an English Translation thereof.

(Continued)

*Primary Examiner* — Henry Yuen
*Assistant Examiner* — Hung D Nguyen
(74) *Attorney, Agent, or Firm* — Buchanan Ingersoll & Rooney PC

(57) ABSTRACT

An induction heating unit enabling to attaching coil on coil attaching surface of bobbin with a high degree of accuracy, and a fixing device capable of maintaining the distance between the coil and the member to be heated at a high degree of accuracy, ensuring uniformity of temperature distribution of the member to be heated, rising temperature at a high speed, and enhancing quality of fixation. In an induction heating unit 30 including a magnetizing coil 39 attached on a coil bobbin 38 which is disposed outside of annular body 19 to be heated, the unit including: a layer of elastic adhesive 44*a* provided on the outer surface of the coil bobbin 38; a magnetizing coil 39 provided on the layer of elastic adhesive 44*a*, the magnetizing coil 39 being wound beforehand following an attaching surface; and a layer of elastic adhesive 44*b* provided on the magnetizing coil 39.

6 Claims, 10 Drawing Sheets

FOREIGN PATENT DOCUMENTS

| | | | |
|---|---|---|---|
| JP | 2000-275991 | | 10/2000 |
| JP | 2001-034097 | | 2/2001 |
| JP | 2002-043047 | | 2/2002 |
| JP | 2002-174971 | A | 6/2002 |
| JP | 2002-373774 | A | 12/2002 |
| JP | 2005-108603 | | 4/2005 |
| JP | 2006-004908 | | 1/2006 |
| JP | 2006-172745 | | 6/2006 |
| WO | WO 86/06868 | | 11/1986 |
| WO | WO 2004/063819 | | 7/2004 |

OTHER PUBLICATIONS

Notification of Reason for Refusal in JP 2006-324148 dated May 19, 2009, and an English Translation thereof.

Notification of Reason for Refusal in JP 2006-324148 dated Sep. 24, 2008, and a English Translation thereof.

* cited by examiner

INDUCTION HEATING UNIT, FIXING DEVICE AND METHOD FOR ATTACHING COIL FOR INDUCTION HEATING UNIT

This application is based on application No. 2006-324148 filed in Japan on Nov. 30, 2006, the contents of which are hereby incorporated by reference.

BACKGROUND OF THE INVENTION

The present invention relates to an induction heating unit used as a heat source of fixing device in an image forming apparatus such as copying machine, printer, FAX and complex machine thereof, particularly to a coil heating structure. The present invention also relates to a fixing device using the induction heating unit and a method for attaching coil for the induction heating unit.

Conventionally, a heating roller system using a halogen heater has been adopted as a heat source for fixing device of image forming apparatus. From an energy-conservation point of view, an induction heating system having a high heat transfer efficiency has been focused on and developed for practical use. In the fixing device using the induction heating system, a heat transfer efficiency same as or higher than the heating roller system is obtained so that the device can be quickly started up. Especially, an induction heating unit in which magnetic flux generated by coil is directed to heating layer through core material such as ferrite is compact and efficiency.

The fixing device has a fixing roller and a press roller which surfaces come into contact with each other and are rotatable. The fixing roller comprises at least five layers of in order from inside support layer, sponge layer, electromagnetic induction heating layer, resilient layer, and releasing layer. Due to magnetic flux generated by a magnetic flux generating means provided around the fixing roller, the electromagnetic induction heating layer of the fixing roller produces heat. When a recording material with an unfixed toner image supported is conveyed and sandwiched in the nip portion between the fixing roller and the press roller, the unfixed toner image on the recording material is melted due to the heat of the heated electromagnetic induction heating layer and fixed to the recording material.

In such fixing device of electromagnetic induction heating system, in order to ensure quality of fixation, it is required to heat the member to be heated in uniform distribution of temperature and rise the temperature at high speed. However, if heat capacity of the member to be heated is made lower in order to obtain a high speed temperature rising property, it would be difficult to ensure a uniformity of the temperature distribution. In order to uniform the temperature distribution, it is necessary to maintain a distance between the coil and the member to be heated with a high degree of accuracy.

As a bobbin to which the coil is attached is metal molded, the geometry of the coil attaching surface has high accuracy. So the distance between the coil attaching surface of the bobbin and the member to be heated can be maintained in a high degree of accuracy. Therefore, it is important to attaching the coil on the coil attaching surface.

As a method for attaching the coil on the bobbin, as shown in FIG. 13, there has been a method of directly attaching coil 54 on the coil attaching surface of a bobbin 53 disposed outside of a fixing belt 52 which is provided around a heating roller 51. In this method, loose of the coil 54 makes it difficult to ensure the accuracy of the distance between the coil 54 and the heating roller 51 that is a member to be heated. Further, thermal expansion at high temperature and vibration causes the coil 54 to shift and flip-flop. Especially, in the case that the unit is small and winding number of the coil 54 is low and that the coil 54 is attached in multiple stages, it is difficult to ensure the distance between the coil 54 and the heating roller 51 and also uniform the temperature distribution of the heating roller 51.

As shown in FIG. 14, there has been also a method comprising steps of bonding coil 54 to a bobbin 53 with a silicon adhesive tape 55 and winding PFA tape 56 partly on the coil 54, preventing the coil 54 from raveling. However, in this method, raveling of the coil 54 of parts other than the parts on which the PFA tape 56 is wound may be caused.

The patent document 1 discloses a method in a fixing device for induction heating a fixing roller from inside, as shown in FIG. 15, the method comprising steps of directly winding coil 58 on a bobbin 57 and impregnating the coil 58 with modified silicon resin 59 to bond the coil 58 to bobbin 57, preventing the coil 58 from raveling. The patent document 2 discloses a method in a fixing device for induction heating a fixing roller from inside, the method comprising steps of forming litz wire in a coil wound shape, press forming the coil, and solidifying the coil with adhesive and so on. However, these methods have disadvantages that torsional deformation is generated in the coil due to lack of adhesion force; accuracy of the distance between the coil and the member to be heated becomes worsen; temperature distribution does not become uniform; and noise due to slack of the coil is generated.

Patent Document 1; JP2002-174971A
Patent Document 2; JP2002-373774A

SUMMARY OF THE INVENTION

In view of the problems described above, it is an object of the present invention to provide an induction heating unit enabling to attaching coil on coil attaching surface of bobbin with a high degree of accuracy, a method for attaching coil for the induction heating unit and a fixing device capable of maintaining the distance between the coil and the member to be heated at a high degree of accuracy, ensuring uniformity of temperature distribution of the member to be heated, rising temperature at a high speed, and enhancing quality of fixation.

In order to attain the above object, according to a first aspect of the present invention, there is provided an induction heating unit comprising a magnetizing coil attached on a coil bobbin which is disposed outside of annular body to be heated, the unit comprising:

a layer of elastic adhesive provided on the outer surface of the coil bobbin;

a magnetizing coil provided on the layer of elastic adhesive, the magnetizing coil being wound beforehand following an attaching surface; and a layer of elastic adhesive provided on the magnetizing coil.

In the specification, the phrase of "annular body to be heated" means a roller having a circular cross section, a belt having a circular cross section provided on the outer surface of the roller, and an endless belt supported in two rollers and so on. The term of "attaching surface" means a surface on the coil bobbin on which the coil is attached. The term of "elastic adhesive" means an adhesive which maintains an elasticity like a rubber even after being hardened.

Preferably, the unit further comprises:

an insulating sheet provided on a part of the layer of elastic adhesive on the magnetizing coil;

a layer of elastic adhesive provided on the insulating sheet;

a first demagnetizing coil provided on the layer of elastic adhesive, the demagnetizing coil being wound beforehand following an attaching surface; and a layer of elastic adhesive provided on the first demagnetizing coil.

Preferably, the unit further comprises:

an insulating sheet provided on a part of the layer of elastic adhesive on the first demagnetizing coil;

a layer of elastic adhesive provided on the insulating sheet;

a second demagnetizing coil provided on the layer of elastic adhesive, the demagnetizing coil being wound beforehand following an attaching surface; and a layer of elastic adhesive provided on the second demagnetizing coil.

According to a second aspect of the present invention, there is provided an induction heating unit comprising a magnetizing coil attached on a coil bobbin which is disposed outside of annular body to be heated, wherein a magnetizing coil wound beforehand following an attaching surface is bonded on the outer surface of the coil bobbin by an elastic adhesive and wherein an elastic adhesive is applied on the outer surface of the magnetizing coil.

Preferably, an insulating sheet is provided on a part of the elastic adhesive on the magnetizing coil; a first demagnetizing coil wound beforehand following an attaching surface is bonded on the insulating sheet by an elastic adhesive; and an elastic adhesive is applied on the outer surface of the first demagnetizing coil.

Preferably, an insulating sheet is provided on a part of the elastic adhesive on the first demagnetizing coil; a second demagnetizing coil wound beforehand following an attaching surface is bonded on the insulating sheet by an elastic adhesive; and an elastic adhesive is applied on the outer surface of the second demagnetizing coil.

Preferably, the magnetizing coil, the first demagnetizing coil and the second demagnetizing coil are formed by winding ritz wire on a winding jig having a winding surface which follows the attaching surface thereof.

Preferably, the magnetizing coil, the first demagnetizing coil and the second demagnetizing coil are held in the shape of the outer surface of the attaching surface thereof by self fusion bonding.

According to a third aspect of the present invention, there is provided a fixing device comprising:

an induction heating unit;

a fixing roller as a member to be heated; and a press roller which comes into press contact with the fixing roller to form a fixing nip portion for sandwiching a recording medium.

According to a fourth aspect of the present invention, there is provided a method for attaching coil on a coil bobbin for an induction heating unit, comprising steps of:

preparing a magnetizing coil wound beforehand following a surface shape of the coil bobbin;

applying an elastic adhesive uniformly on the outer surface of the coil bobbin;

setting the magnetizing coil on the elastic adhesive;

pressing the outer surface of the magnetizing coil uniformly;

heating the coil bobbin and the magnetizing coil to harden the elastic adhesive; and applying an elastic adhesive on the outer surface of the magnetizing coil.

According to the induction heating unit in the first aspect of the present invention, as the magnetizing coil wound beforehand following an attaching surface is provided on the layer of elastic adhesive, it is possible to maintain an accuracy of the distance between the coil and the member to be heated and make the temperature distribution of the member to be heated uniform. It is also possible to eliminate a creaking noise due to a difference of thermal expansion between the magnetizing coil and the coil bobbin.

According to the induction heating unit in the second aspect of the present invention, as the magnetizing coil wound beforehand is bonded on the coil bobbin by the elastic adhesive, it is possible to maintain an accuracy of the distance between the coil and the member to be heated and make the temperature distribution of the member to be heated uniform. It is also possible to eliminate a creaking noise due to a difference of thermal expansion between the magnetizing coil and the coil bobbin.

According to the fixing device in the third aspect of the present invention, as the device has the induction heating unit enabling to maintain an accuracy of the distance between the coil and the member to be heated and make the temperature distribution of the member to be heated uniform, it is possible to enhance the quality of fixation.

According to the method for attaching coil in the fourth aspect of the present invention, as the magnetizing coil wound beforehand is bonded on the coil bobbin by the elastic adhesive, it is possible to maintain an accuracy of the distance between the coil and the member to be heated and make the temperature distribution of the member to be heated uniform.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

Figure 1:
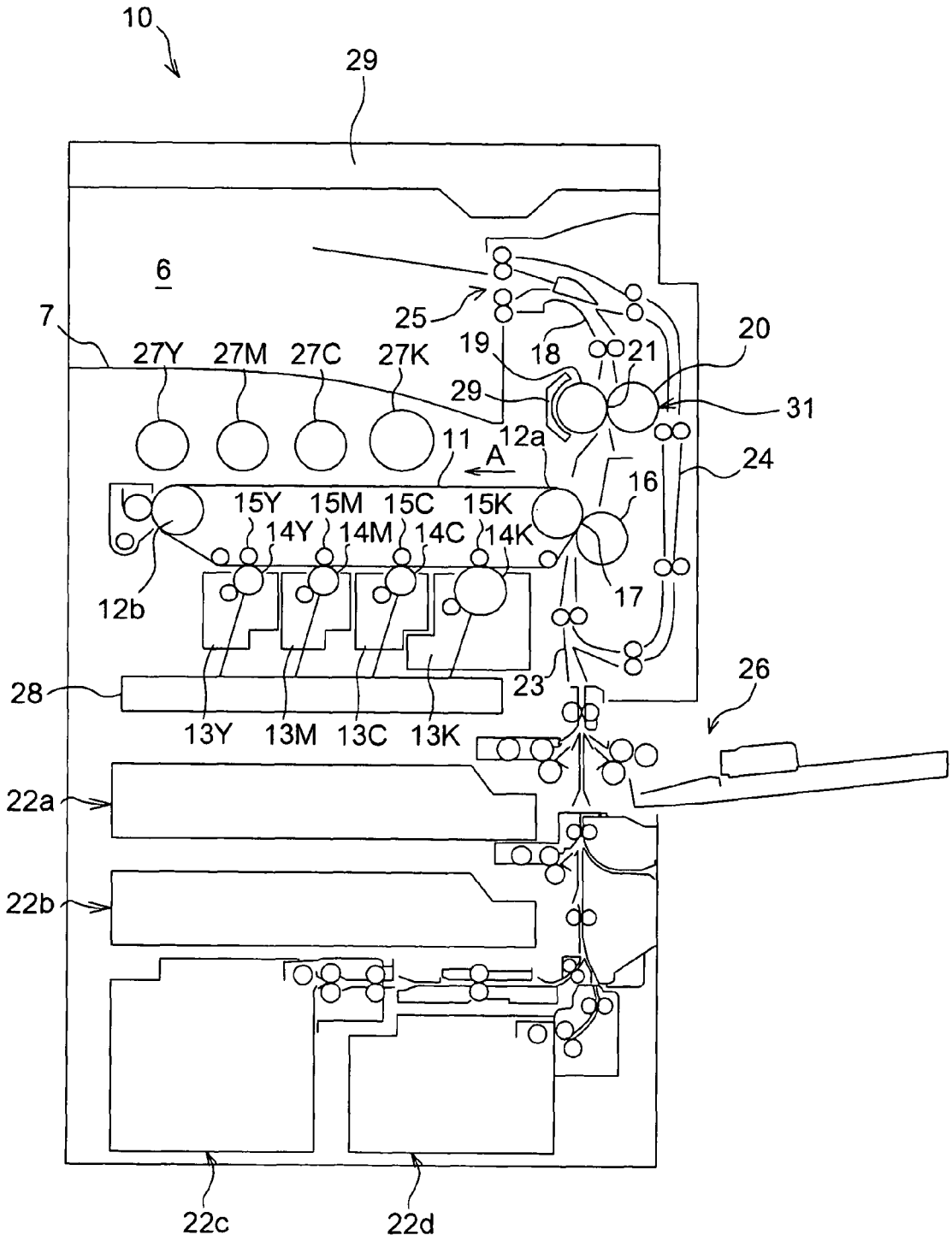
FIG. 1 is a sectional view showing inner constitution of an image forming apparatus provided with a fixing device comprising an induction heating unit according to the present invention.

FIG. 1 shows a schematic construction of the image forming apparatus 10 provided with a fixing device according to the present invention. The image forming apparatus 10 is provided with an intermediate transfer belt 11 in the nearly center of the inside. The intermediate transfer belt 11 is supported on the outer circumference of rollers 12*a*, 12*b* and driven to rotate in the direction of arrow A. Beneath the lower horizontal portion of the intermediate transfer belt 11, four imaging units 13Y, 13M, 13C, 13K corresponding to each color of yellow (Y), magenta (M), cyan (C) and black (K) are disposed along the intermediate transfer belt 11. Inside the intermediate transfer belt 11 are disposed first transfer rollers 15Y, 15M, 15C, 15K which are opposed to photosensitive drums 14Y, 14M, 14C, 14K of the imaging units 13Y, 13M, 13C, 13K via the intermediate transfer belt 11. A second transfer roller 16 comes into contact with the part supported by the drive roller 12*a* of the intermediate transfer belt 11. The nip portion between the second transfer roller 16 and the intermediate belt 11 is a second transfer area 17. In the paper path 18 on the down stream side of the second transfer area 17, a fixing roller 19 and a press roller 20 are disposed. The press contact portion of the fixing roller 19 and the press roller 20 is a fixing nip area 21.

In the lower portion of the image forming apparatus 10, four kinds of first, second, third and fourth paper feed portions 22*a*, 22*b*, 22*c*, 22*d* are provided. The first paper feed portion 22*a* and the second paper feed portion 22*b* are disposed up and down. The third paper feed portion 22*c* and the fourth paper feed portion 22*d* are disposed right and left below the second paper feed portion 22*b*. The paper stacked and contained in each of the paper feed portions 22*a*, 22*b*, 22*c*, 22*d* is fed one by one from the upper most one to the paper passage 23. A circulation passage 24 is formed on the side portion of the image forming apparatus 10. The paper with one surface printed which switchbacks at a paper discharge roller 25 is conveyed downward through the circulation passage 24 and then conveyed upward again through the paper passages 23, 18 in a state that the unprinted surface faces the side of the intermediate transfer belt 11. A manual paper feed unit 26 is disposed below the circulation passage 24. The paper fed from the manual paper feed unit 26 is conveyed upward through the paper passage 23. Numerals 27Y, 27M, 27C, 27K denote toner cartridges for feeding toner of each color to the imaging units 13Y, 13M, 13C, 13K. Numeral 28 shows a control unit for controlling the imaging units 13Y, 13M, 13C, 13K.

Next, brief operation of the image forming apparatus 10 having the above construction will be described. Color print data obtained by reading an image at an image reading portion 29 or image data outputted from a personal computer or so is given a predetermined signal processing at the control unit 28 and transmitted to each of the imaging units 13Y, 13M, 13C, 13K as image signals for each color of yellow (Y), magenta (M), cyan (C) and black (K). In each of the imaging units 13Y, 13M, 13C, 13K, a laser light modulated by the image signal is projected on the photosensitive drums 14Y, 14M, 14C, 14K to form an electrostatic latent image. The latent image formed on each of the photosensitive drums 14Y, 14M, 14C, 14K is developed by the respective developing unit to form a toner image of yellow, magenta, cyan, black on the photosensitive drums 14Y, 14M, 14C, 14K. The toner images of yellow, magenta, cyan, black are superimposed and first transferred on the moving intermediate transfer belt 11 under the operation of the first transfer rollers 15Y, 15M, 15C, 15K. The superimposed toner image formed on the intermediate transfer belt 11 reaches the second transfer area 17 as the intermediate transfer belt 11 moves. In the second transfer area 17, the superimposed toner image is second transferred on a paper fed from the paper feed portions 22*a*, 22*b*, 22*c*, 22*d* or the manual paper feed unit 26 under the operation of the second transfer roller 16. Then, the paper on which the toner image is second transferred reaches the fixing nip area 21. In the fixing nip area 21, the toner image is fixed on the paper under the operation of the fixing roller 19 and the press roller 20. The paper P on which the toner image is fixed is discharged on the discharge tray 7 through the discharge roller 25.

Figure 2:
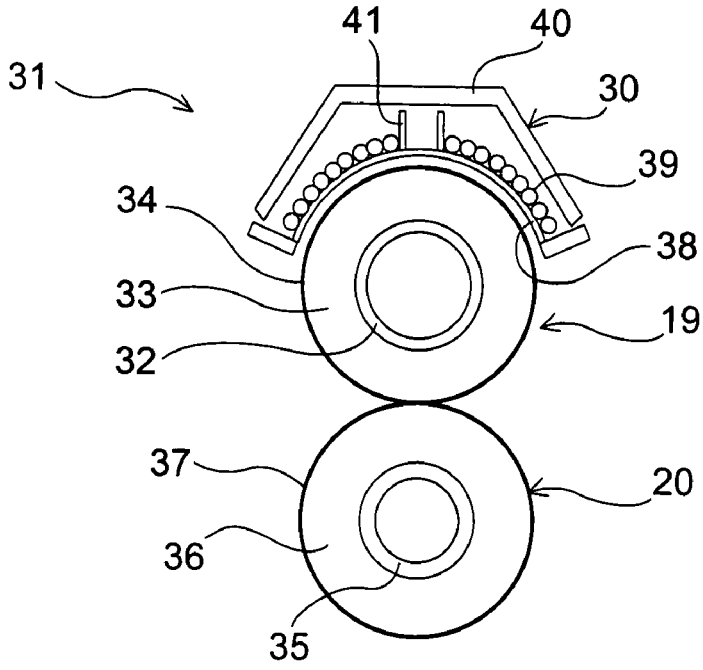
FIG. 2 is a sectional view of the fixing device comprising an induction heating unit according to a first embodiment of the present invention.

FIG. 2 shows a detailed sectional view of a fixing device 31 according to a first embodiment of the present invention. The fixing device 31 comprises the fixing roller 19, the press roller and an induction heating unit 30.

The fixing roller 19 is consist of a core 32 comprising a stainless steel pipe, a silicon sponge layer 33 covered on the core 32 and a fixing belt 34 attached on the silicon sponge layer 33. The fixing belt 34 comprises an endless electrocast sleeve, silicon rubber and PFA tube covered on the sleeve.

The press roller 20 is consist of a core 35 comprising a steel pipe, a silicon sponge layer 36 covered on the core 35 and a PFA tube 37 covered on the silicon sponge layer 36.

Figure 3:
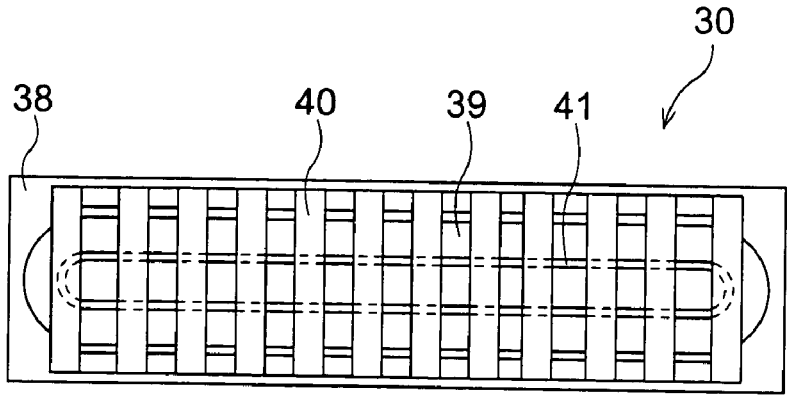
FIG. 3 is a front view of the induction heating unit of FIG. 2.
Figure 4:
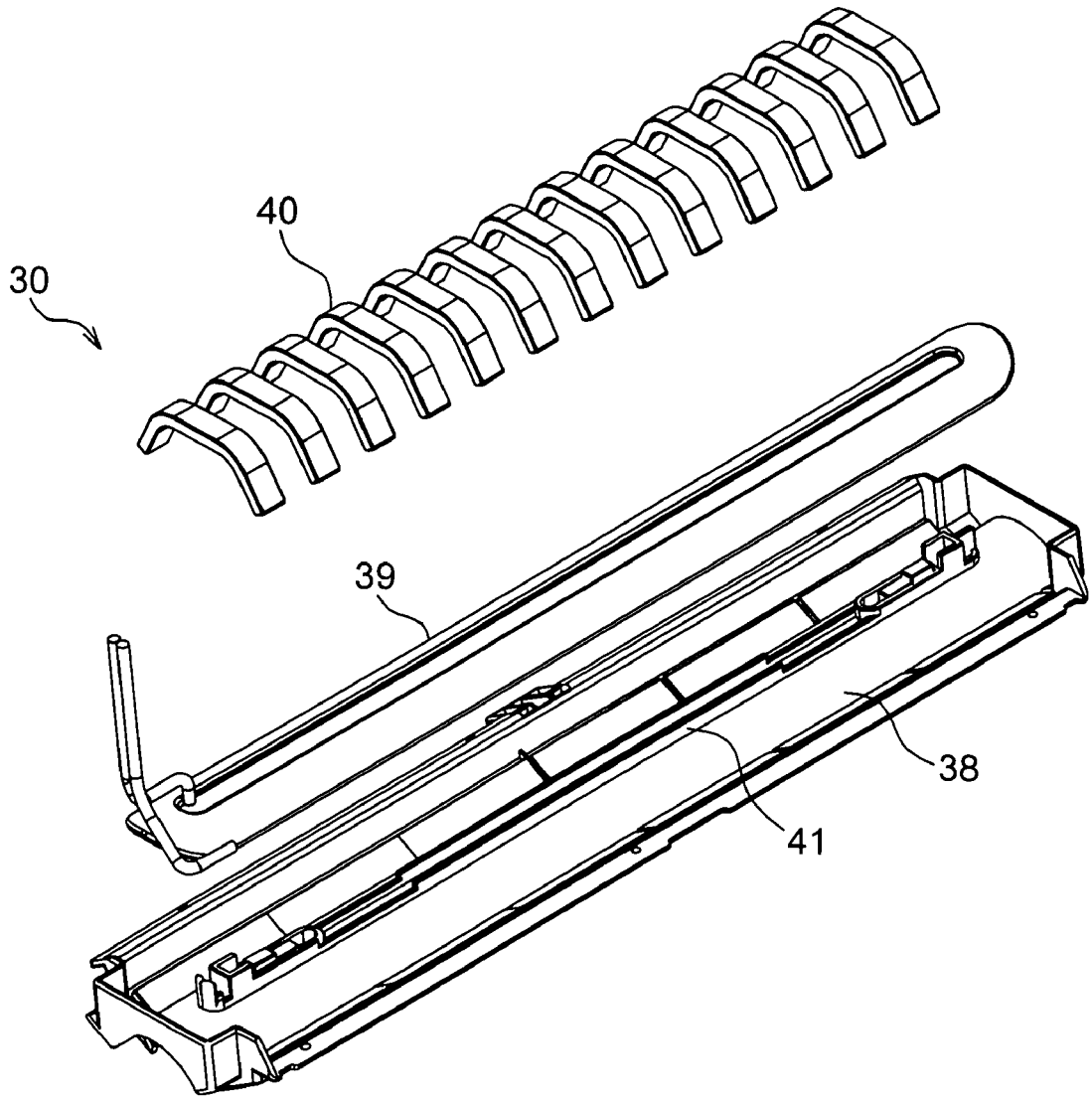
FIG. 4 is a fragmental perspective view of the induction heating unit of FIG. 3.

The induction heating unit 30, as shown in FIGS. 3, 4, comprises a coil bobbin 38, a magnetizing coil 39 and a core 40.

The coil bobbin 38 has a plate like shape that curves in a circular arc pattern along the outer surface of the fixing roller 19 so as to cover the substantially half surface of the fixing roller 19 and extends in the axial direction of the fixing roller 19. An oblong or track shape of rib 41 extending in the longitudinal direction is formed on the middle of the outer surface of the coil bobbin 38. As the coil bobbin 38, liquid crystal polymer, PPS (polyphenylen sulfide), PEEK® (trade mark of Victrex plc), or phenol resin can be used but is not limited to these. The profile tolerance of the outer surface of the coil bobbin 38 to the center of the fixing roller 19 is less than 0.4. The profile tolerance is a difference between maximum and minimum of radius from the center of the fixing roller 19 at measurement positions that are provided at a predetermined pitch both in the longitudinal direction and the circumferential direction of the coil bobbin 38.

The magnetizing coil 39 is consisted of a litz wire comprising twisted and bound element wires. As shown in FIG. 3, the magnetizing coil 39 has a construction wound around the rib 41 of the coil bobbin 38. The construction for attaching the magnetizing coil 39 will be described in detail hereinafter. Considering that the litz wire receives heat transmission, the litz wire coated with heat resistant resin is preferably used.

The core 40 comprises a plurality of magnetic bodies each of which has a bar like shape bended and extended in the circumference direction of the coil bobbin 38. The magnetic bodies are disposed at a predetermined pitch in the longitudinal direction of the coil bobbin 38 and attached to the coil bobbin 38 to cover the outer surface of the magnetizing coil 39.

A method for attaching the magnetizing coil 39 onto the coil bobbin 38 will be described below. First, a winding jig not shown comprising a winding surface having the same shape as the outer surface of the coil bobbin 38, a rib having the same shape as the rib 41 of the coil bobbin 38, and a flange extending along the winding surface on both sides of the rib is prepared.

Using the winding jig, the litz wire is wound and heated so that the wound litz wire is self fusion bonded and held in the shape of the outer surface of the coil bobbin 38 to form the magnetizing coil 39 as shown in FIG. 4.

Figure 5:
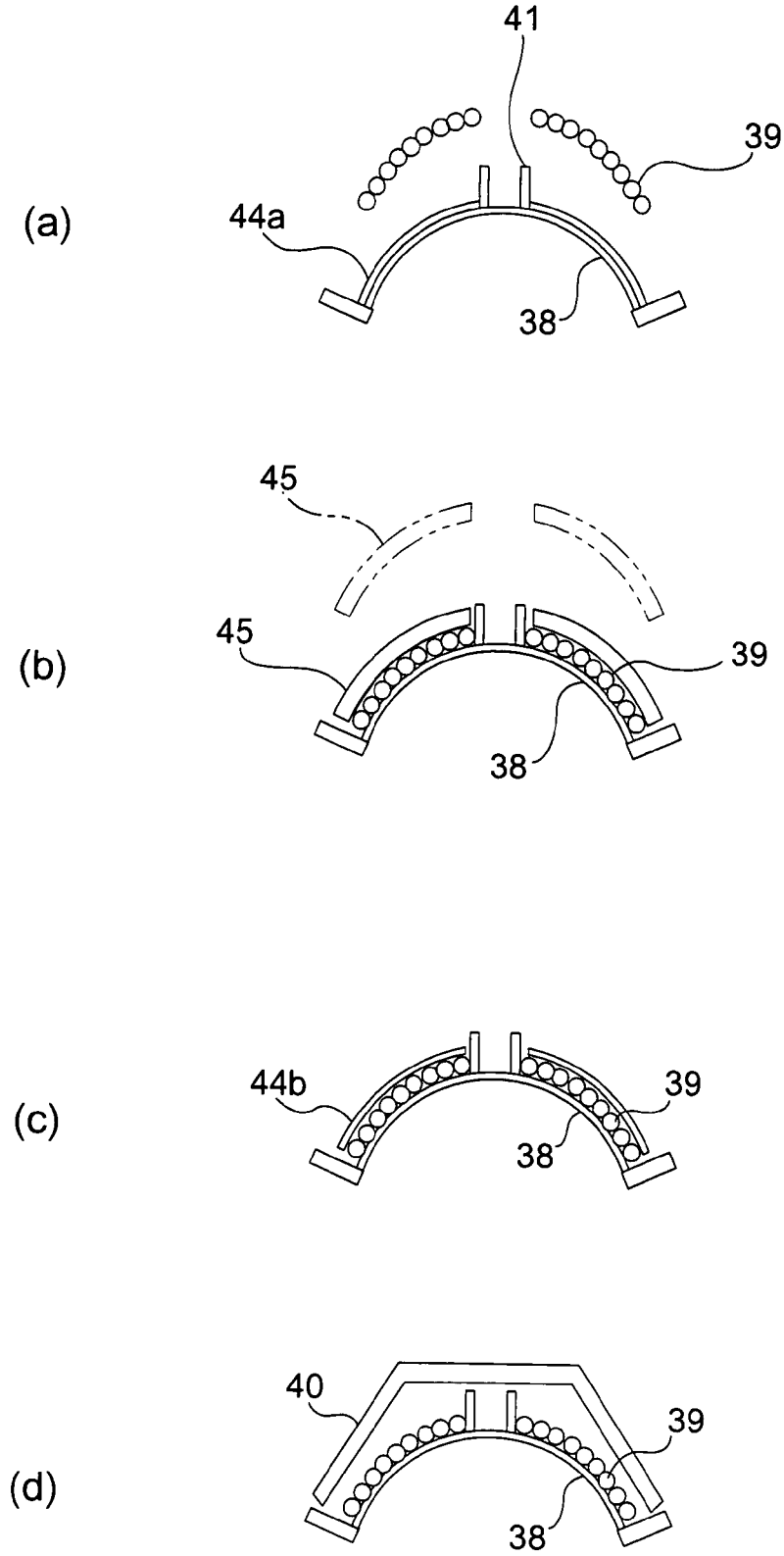
FIG. 5 is sectional views showing attaching procedure of magnetizing coil.

Then, as shown in FIG. 5(*a*), a heat resistant elastic adhesive 44*a* is uniformly applied on the outer surface of the coil bobbin 38. The magnetizing coil 39 is set on the coil bobbin 38 so that the rib 41 the coil bobbin 38 is inserted into the inner diameter portion of the magnetizing coil 39. As shown in FIG. 5(*b*), the outer surface of the magnetizing coil 39 is uniformly pressed using a press jig 45. Thus, the magnetizing coil 39 follows and adheres in a contact state to the outer surface of the coil bobbin 38. After that, the elastic adhesive 44*a* is hardened so that the magnetizing coil 39 does not depart from the coil bobbin 38. When the magnetizing coil 39 is removed from the magnetizing coil 39, warpage due to residual stress is apt to occur. However, as the elastic adhesive 44*a* is hardened during pressure using the pressure jig 45, the warpage is corrected. A departure of less than 0.1 mm from the outer surface of the coil bobbin 38 of the magnetizing coil 39 is acceptable. Subsequently, as shown in FIG. 5(C), an elastic adhesive 44*b* is applied on the outer surface of the magnetizing coil 39 and hardened, preventing the magnetizing coil 39 from raveling. Lastly, as shown in FIG. 5(*d*), the core 40 is attached on the coil bobbin 38.

Figure 6:
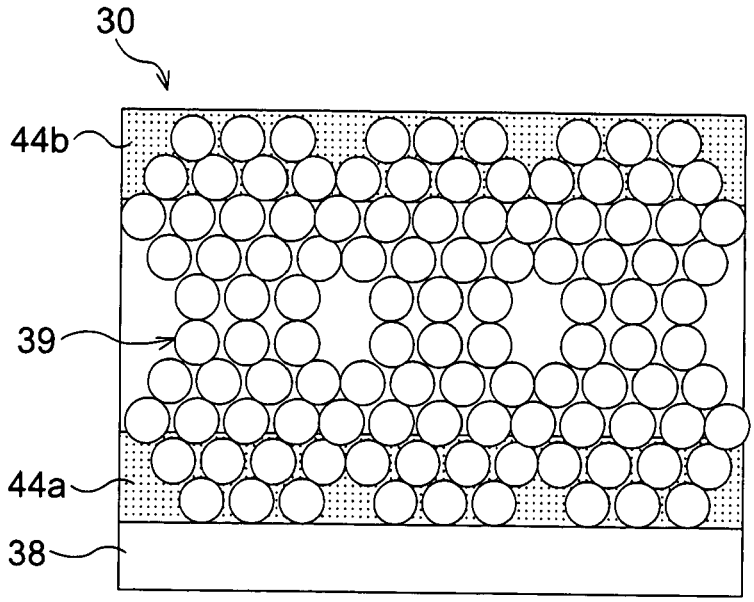
FIG. 6 is a sectional view showing attaching structure of the magnetizing coil of FIG. 3.

FIG. 6 shows a sectional view of the induction heating unit by attaching the magnetizing coil 39 on the coil bobbin 38 as described above. The induction heating unit 30 comprises a layer of elastic adhesive 44*a* provided on the outer surface of the coil bobbin 38; the magnetizing coil 39 provided on the layer of elastic adhesive 44*a*, the magnetizing coil 39 wound beforehand following the attaching surface; and a layer of elastic adhesive 44*b*.

In the conventional method for winding coil directly on a coil bobbin, it has been necessary to form the coil bobbin larger without any protrusions in order to prevent the coil during the wind from interfering with each part of the coil bobbin. On the other hand, in the present invention, as the magnetizing coil 39 wound beforehand by the winding jig is bonded to the coil bobbin, even if there is a protrusion in the vicinity of the attaching surface, the protrusion does not get in the way of attaching the coil. Thus, in comparison with the conventional construction in which the coil is wound directly on the coil bobbin, the present invention is possible to downsize the device.

The elastic adhesive 44*a*, 44*b* is necessary to have a heat resistance of at lest more than 180° C. Also, it is important that the elastic adhesive 44*a*, 44*b* has rubber elasticity after hardening. In an example, RVT rubber KE3418 (Shin-Etsu Chemical Co., Ltd.) was used. Also, one-component system, two-component system and more than three-component system of silicon rubber, and LTV type, RTV type or HTV type of silicon rubber can be used.

The self fusion bonding of the magnetizing coil 39 is performed by fusion bonding the enamel layer on the surface of the litz wire at the temperature of 180 to 220° C. to hold the wire in the curved shape of the coil bobbin 38.

When using the induction heating unit 30, it is necessary to set a margin of heating temperature in order to prevent the magnetizing coil 39 from being heated to a temperature of more than fusion-bonding temperature of the enamel layer. It is possible to cope with a speed up of the image forming apparatus 10 by air cooling the magnetizing coil 39 or whole of the induction heating unit 30 when the magnetizing coil 39 becomes more than fusion bonding temperature in use.

As the coil bobbin 38 and the magnetizing coil 39 are different in thermal expansion coefficient, the difference of thermal expansion is caused due to the heat generated in use of the image forming apparatus 10. However, the elastic adhesive 44*a* allows the magnetizing coil 39 to follow the expansion of the coil bobbin 38, absorbing the difference of thermal expansion. Thus, departure of the magnetizing coil 39 would be never caused and accuracy of the distance between the magnetizing coil 39 and the fixing roller 19 that is a member to be heated could be ensured, reducing generation of noise due to slack of the magnetizing coil 39.

Quantity of thermal expansion of the coil bobbin 38 and the magnetizing coil 39 when heating the induction heating unit 30 from normal temperature 20° C. to actual normal temperature 200° C. was calculated. Where, material and linear thermal coefficient of the coil bobbin 38 and the magnetizing coil 39 of the induction heating unit 30 were as shown in Table 1 and dimension in the axial direction were 360 mm. As a result, as shown in Table 1, difference of the quantity of the thermal expansion between the coil bobbin 38 and the magnetizing coil 39 was 1.4 mm. In the experiment, almost same result was obtained.

TABLE 1

| | Material | Linear thermal coefficient ($10^{-5}$ ° C.) | Quantity of thermal expansion (mm) |
|---|---|---|---|
| Coil Bobbin | A130 | 4.4 | 2.4 |
| Magnetizing Coil | Copper | 1.9 | 1.0 |

Figure 7:
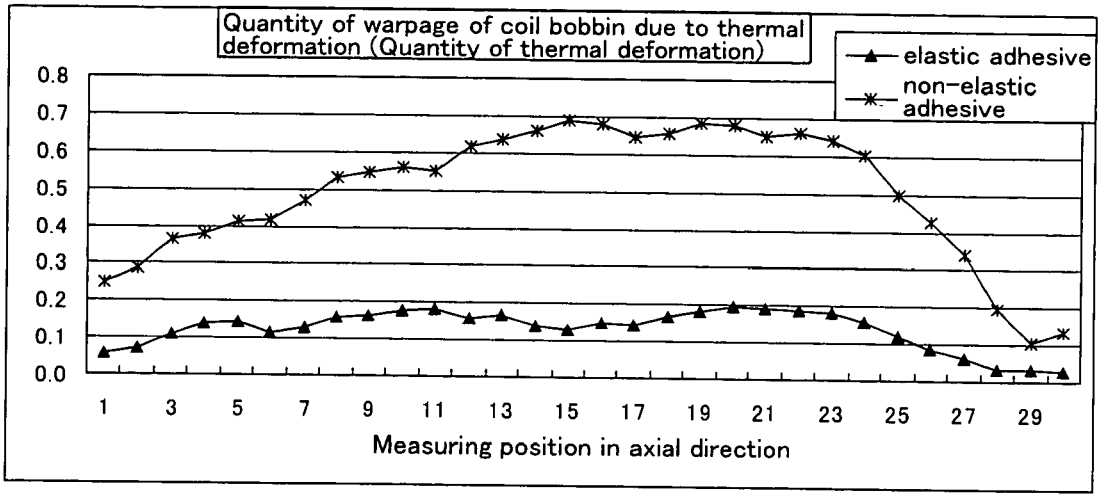
FIG. 7 is a graph showing quantity of warpage of the fixing roller.

The difference of the quantity of the thermal expansion between the coil bobbin 38 and the magnetizing coil 39 causes the coil bobbin 38 to warp. FIG. 7 shows quantity of warpage (curve of "▲" in the figure) of the inner surface of the coil bobbin 38 of the induction heating unit 30 according to the present invention in which the elastic adhesive (KE3417) was used for bonding the coil bobbin 38 and the magnetizing coil 39 and quantity of warpage (curve of "*" in the figure) of the inner surface of the coil bobbin of conventional induction heating unit in which non-elastic adhesive was used.

As clear from the figure, the quantity of warpage of the inner surface of the coil bobbin in the case that non-elastic adhesive was used was 0.7 mm. On the other hand, the quantity of warpage of the inner surface of the coil bobbin 38 in the case that elastic adhesive (KE3417) was used according to the present invention was 0.2 mm.

Figure 8:
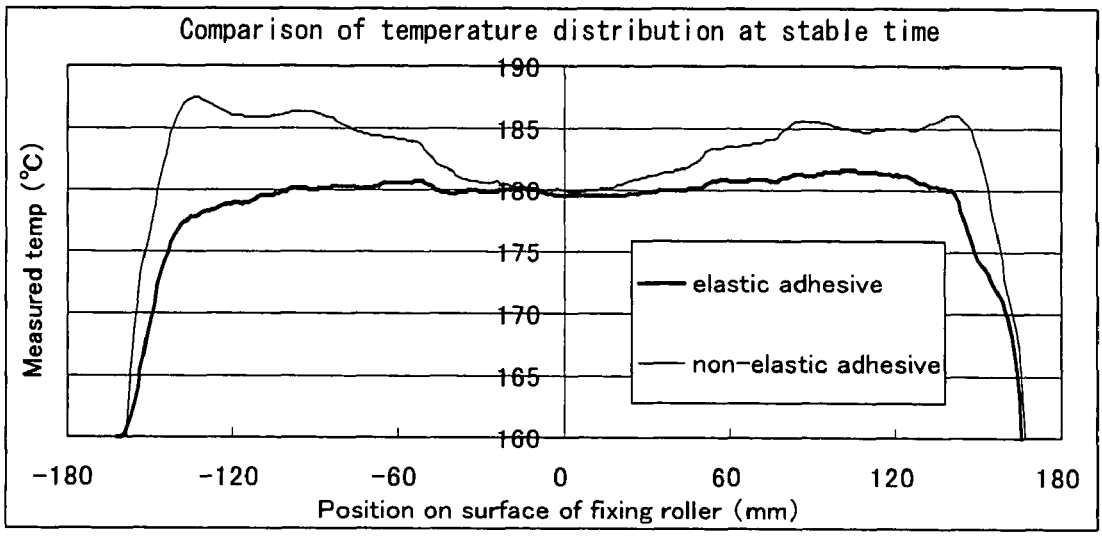
FIG. 8 is a graph showing temperature distribution of the fixing roller.

The warpage of the coil bobbin 38 causes the distance between the magnetizing coil 39 and the fixing roller 19 to change and affects the temperature distribution in the axial direction of the surface of the fixing roller 19. FIG. 8 shows temperature distribution (curve of thick line in the figure) of the fixing roller 19 of the induction heating unit 30 according to the present invention in which the elastic adhesive (KE3417) was used for bonding the coil bobbin 38 and the magnetizing coil 39 and temperature distribution (curve of thin line in the figure) of the fixing roller of the conventional induction heating unit in which non-elastic adhesive was used.

As clear from the figure, the temperature distribution of the surface of the fixing roller in the case that non-elastic adhesive was used as in the conventional unit was that both ends portion was higher by 7° C. than the center. On the other hand, the temperature distribution of the surface of the fixing roller 19 in the case that elastic adhesive (KE3417) was used according to the present invention was substantially flat and had a maximum difference of 2° C.

The difference of the quantity of thermal expansion between the coil bobbin 38 and the magnetizing coil 39 and the temperature change between the low-temperature time and the high-temperature time generate a "creaking" noise from the contact portion of the coil bobbin 38 and the magnetizing coil 39. Table 2 shows existence or nonexistence of the creaking noise of the induction heating unit 30 according to the present invention in which the elastic adhesive (KE3417) was used for bonding the coil bobbin 38 and the magnetizing coil 39 and existence or nonexistence of the creaking noise of the conventional induction heating unit in which non-elastic adhesive was used. The test was performed by 5 minutes observation after endurance printing and entrusted to a tester.

As clear from the table, in the case that non-elastic adhesive was used as in the conventional unit, the bonding was hard and the creaking noise was easily generated. The creaking noise began to occur from 24 hours endurance printing and occurred frequently at 1000 hours endurance printing. On the other hand, in the case that elastic adhesive (KE3417) was used according to the present invention, no creaking noise was occurred even at 1000 hours endurance printing.

TABLE 2

| Endurance printing time | Elastic adhesive was used (present invention) | Non-elastic adhesive was used (conventional unit) |
|---|---|---|
| 0 hr | none | none |
| 24 hr | none | rarely |
| 100 hr | none | occasionally |
| 1000 hr | none | frequently |

Figure 9:
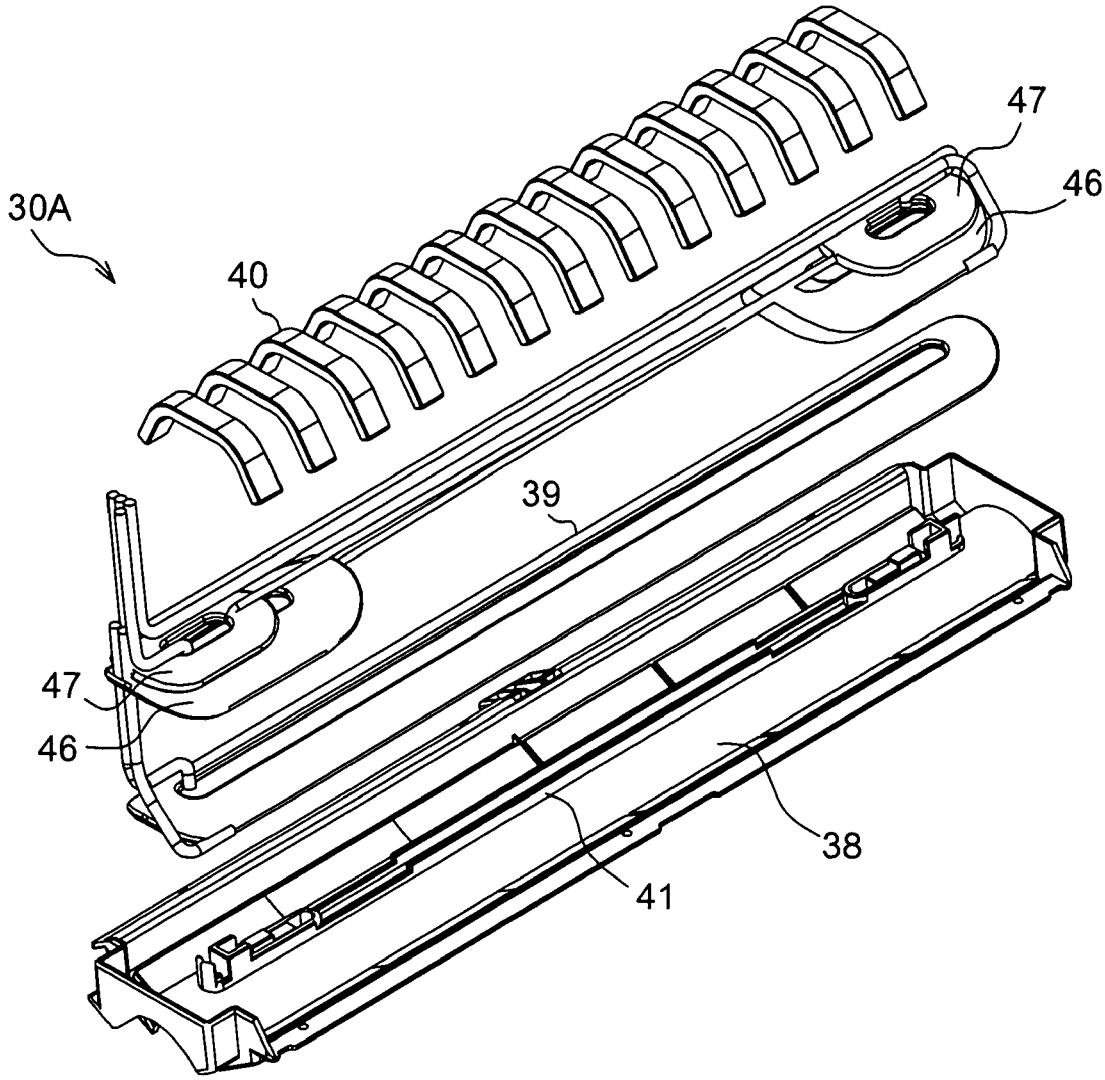
FIG. 9 is a fragmental perspective view of the induction heating unit according to a second embodiment of the present invention.
Figure 10:
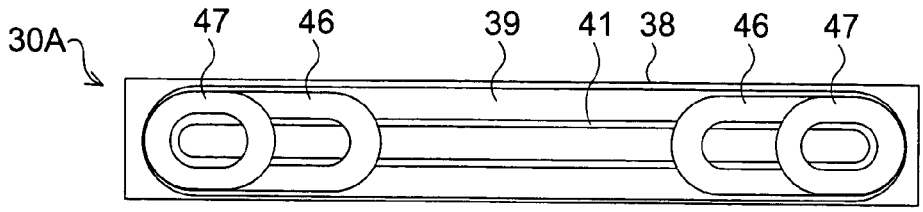
FIG. 10 is a front view of the induction heating unit of FIG. 9.

FIG. 9 is an exploded perspective view of an induction heating unit 30A according to a second embodiment of the present invention. FIG. 10 is a front view of the unit. In the induction heating unit 30A, first demagnetizing coils 46 are provided on both ends portion of the magnetizing coil 39 and second demagnetizing coils 47 are provided on the first demagnetizing coils 46. If the length of the magnetizing coil 39 corresponds to the maximum paper size A, the length of the first demagnetizing coil 46 is decided so that the length between the first demagnetizing coils 46 is substantially same as the paper size B smaller than the paper size A. Similarly, the length of the second demagnetizing coil 47 is decided so that the length between the second demagnetizing coils 47 is substantially same as the paper size C smaller than the paper size B.

Figure 11:
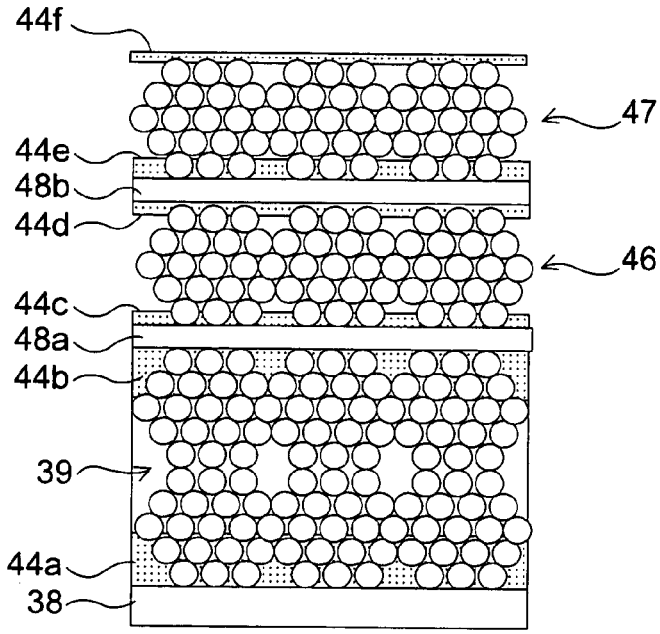
FIG. 11 is a sectional view showing attaching structure of the magnetizing coil of FIG. 6.

The same method as the first embodiment can be adopted until the magnetizing coil 39 is attached on the coil bobbin 38. The first demagnetizing coil 46 is wound using a winding jig in the same manner as the magnetizing coil 39, heated and self fusion bonded and held in the shape of the outer surface of the magnetizing coil 39 that is an attaching surface. On the other hand, as shown in FIG. 11, an insulating sheet 48*a* is set on an elastic adhesive 44*b* applied in the magnetizing coil 39. Then, a heat resistant elastic adhesive 44*c* is uniformly applied on the insulating sheet 48*a* to bond the wound first demagnetizing coil 46. The first demagnetizing coil 46 is uniformly pressed using a press jig and applied with an elastic adhesive 44*d*. Further, in the same manner, an insulating sheet 48*b*, an elastic adhesive 44*e*. the second demagnetizing coil 47 and an elastic adhesive 44*f* are provided. The most upper surface is protected by a glass cloth tape, a heat resistant tape not shown. As the insulating sheet 48*a*, 48*b*, a Nomex sheet (made by NITTO DENKO CORPORATION) is preferable but a polyimide sheet, a fluorine sheet or so is possible if insulation property and heat resistance are ensured.

The induction heating unit 30A comprises: a layer of elastic adhesive 44*a* provided on the outer surface of the coil bobbin 38; the magnetizing coil 39 provided on the layer of elastic adhesive 44*a*, the magnetizing coil 39 being wound beforehand following the attaching surface; a layer of elastic adhesive 44*b* provided on the magnetizing coil 39; an insulating sheet 48*a* provided on the elastic adhesive 44*b*; a layer of elastic adhesive 44*c* provided on the insulating sheet 48*a*; the first demagnetizing coil 46 provided on the layer of elastic adhesive 44*c*, the first demagnetizing coil 46 being wound beforehand following the attaching surface; a layer of elastic adhesive 44*d* provided on the first demagnetizing coil 46; an insulating sheet 48*b* provided on the elastic adhesive 44*d*; a layer of elastic adhesive 44*e* provided on the insulating sheet 48*b*; the second demagnetizing coil 47 provided on the layer of elastic adhesive 44*e*, the first demagnetizing coil 47 being wound beforehand following the attaching surface; and a layer of elastic adhesive 44*f* provided on the second demagnetizing coil 47.

In general, in the case that the paper size is small in comparison with the length of the fixing roller, when continuously passing the paper, fixing operation causes the heat to be drawn from the center portion of the fixing roller though which the small size of paper passes, reducing the temperature of the fixing roller. In order to compensate for this, control to increase the temperature of the fixing roller is performed. However, at the both ends portion through which no paper passes, the fixing operation does not cause decrease of temperature. Thus, the temperature of the both ends increase in comparison with the center portion.

So, in the induction heating unit 30A of the second embodiment, switches for turning on and off current to the first demagnetizing coils 47 and the second demagnetizing coils 47 are closed in response to the paper size to generate a counter electromotive force in the demagnetizing coils 46, 47. Thus, a reverse magnetic field is generated in a direction that change of the magnetic field from the magnetizing coil 39 is prevented, reducing the magnetic field generated from the magnetizing coil 39 at the portions that the demagnetizing coil 46, 47 are disposed. As a result, it is possible to prevent increase of the temperature of the fixing roller 19 only at the range of demagnetizing coils 46, 47. As the first demagnetizing coils 46 and the second demagnetizing coils 47 are attached in the same manner as the magnetizing coil 39, no warpage and no creaking noise occurs, enabling to obtain a uniform temperature distribution of the fixing roller 19. Also, error and decrease of paper passing speed due to temperature anomaly of the fixing roller 19 that are generated in the case that the demagnetizing rollers 46, 47 are not used would not be caused.

Figure 12:
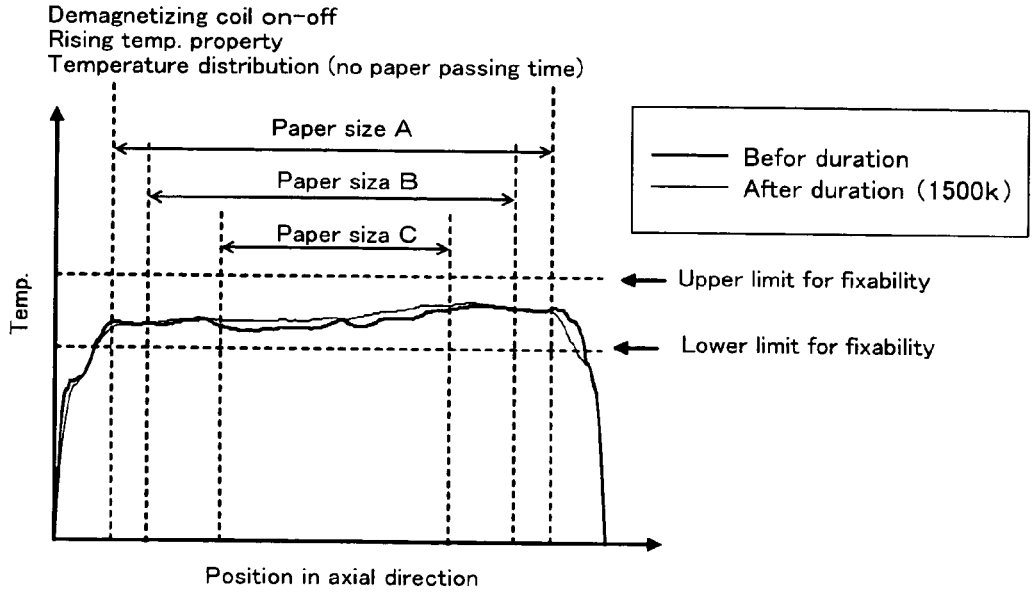
FIG. 12 is a graph showing temperature distribution of the fixing roller before and after endurance printing.
Figure 13:
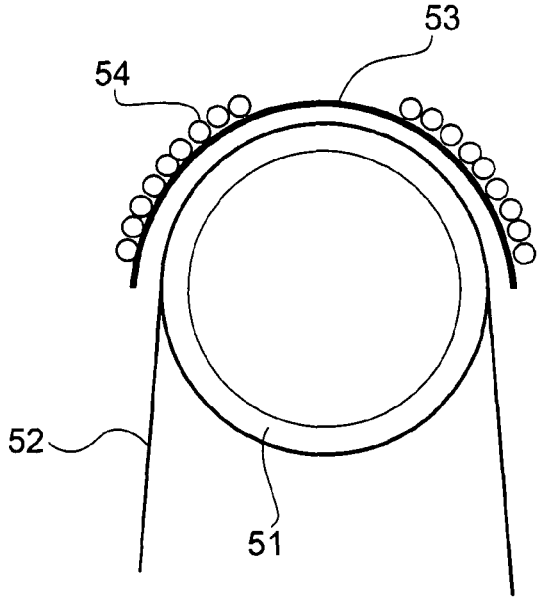
FIG. 13 is a sectional view of a fixing device comprising conventional induction heating unit.
Figure 14:
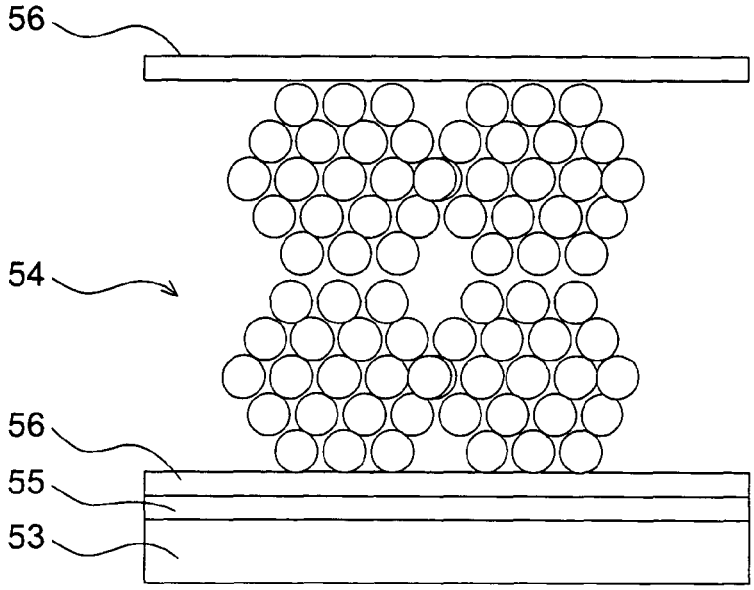
FIG. 14 is a sectional view showing attaching structure of conventional magnetizing coil.
Figure 15:
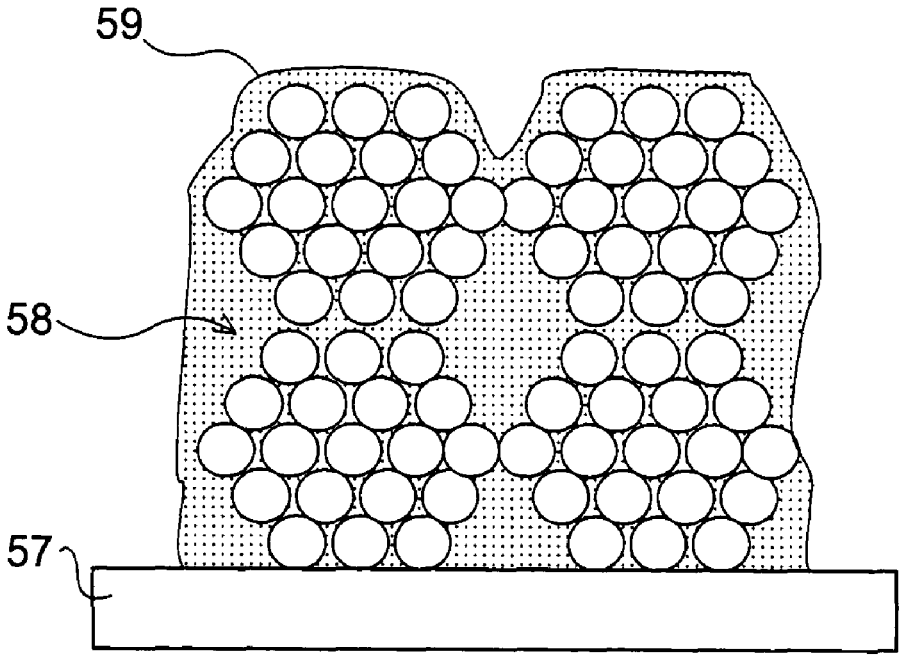
FIG. 15 is a sectional view showing another attaching structure of conventional magnetizing coil.

FIG. 12 shows a temperature distribution of the fixing roller 19 before and after 1500,000 endurance printing by the image forming apparatus having the fixing device using the induction heating unit 30A according to the second embodiment.

As clear from the figure, the temperature distribution before and after the endurance printing was not remains unchanged. This shows that fixing quality can be ensured even after the endurance printing.

Although the present invention has been fully described by way of the examples with reference to the accompanying drawing, it is to be noted that various changes and modifications will be apparent to those skilled in the art. Therefore, unless such changes and modifications otherwise depart from the spirit and scope of the present invention, they should be construed as being included therein.

What is claimed is:

1. An induction heating unit comprising a magnetizing coil attached on a coil bobbin which is disposed outside of an annular body to be heated, the unit comprising:

a first layer of elastic adhesive provided on an outer surface of the coil bobbin;

the magnetizing coil provided on the first layer of elastic adhesive, the magnetizing coil being wound beforehand following an attaching surface;

a second layer of elastic adhesive provided on the magnetizing coil;

a first insulating sheet provided on a part of the second layer of elastic adhesive;

a third layer of elastic adhesive provided on the first insulating sheet;

a first demagnetizing coil provided on the third layer of elastic adhesive, the demagnetizing coil being wound beforehand following an attaching surface;

a fourth layer of elastic adhesive provided on the first demagnetizing coil;

a second insulating sheet provided on a part of the fourth layer of elastic adhesive;

a fifth layer of elastic adhesive provided on the second insulating sheet;

a second demagnetizing coil provided on the fifth layer of elastic adhesive, the demagnetizing coil being wound beforehand following an attaching surface; and a sixth layer of elastic adhesive provided on the second demagnetizing coil.

2. An induction heating unit comprising a magnetizing coil attached on a coil bobbin which is disposed outside of an annular body to be heated, wherein the magnetizing coil wound beforehand following an attaching surface is bonded on an outer surface of the coil bobbin by a first elastic adhesive and wherein a second elastic adhesive is applied on the outer surface of the magnetizing coil, wherein a first insulating sheet is provided on a part of the second elastic adhesive; a first demagnetizing coil wound beforehand following an attaching surface is bonded on the first insulating sheet by a third elastic adhesive; and a fourth elastic adhesive is applied on the outer surface of the first demagnetizing coil, and wherein a second insulating sheet is provided on a part of the fourth elastic adhesive; a second demagnetizing coil wound beforehand following an attaching surface is bonded on the second insulating sheet by a fifth elastic adhesive; and a sixth elastic adhesive is applied on the outer surface of the second demagnetizing coil.

3. The induction heating unit as in claim 2, wherein the magnetizing coil is held in the shape of the outer surface of the coil bobbin by self fusion bonding.

4. The induction heating unit as in claim 2, wherein the first demagnetizing coil is held in the shape of the outer surface of the magnetizing coil by self fusion bonding.

5. The induction heating unit as in claim 2, wherein the second demagnetizing coil is held in the shape of the outer surface of the first demagnetizing coil by self fusion bonding.

6. A fixing device comprising:

an induction heating unit comprising a magnetizing coil attached on a coil bobbin which is disposed outside of an annular body to be heated, the unit comprising:

a first layer of elastic adhesive provided on an outer surface of the coil bobbin;

the magnetizing coil provided on the first layer of elastic adhesive, the magnetizing coil being wound beforehand following an attaching surface;

a second layer of elastic adhesive provided on the magnetizing coil;

a first insulating sheet provided on a part of the second layer of elastic adhesive;

a third layer of elastic adhesive provided on the first insulating sheet;

a first demagnetizing coil provided on the third layer of elastic adhesive, the demagnetizing coil being wound beforehand following an attaching surface;

a fourth layer of elastic adhesive provided on the first demagnetizing coil;

a second insulating sheet provided on a part of the fourth layer of elastic adhesive;

a fifth layer of elastic adhesive provided on the second insulating sheet;

a second demagnetizing coil provided on the fifth layer of elastic adhesive, the demagnetizing coil being wound beforehand following an attaching surface; and a sixth layer of elastic adhesive provided on the second demagnetizing coil;

a fixing roller as a member to be heated; and a press roller which comes into press contact with the fixing roller to form a fixing nip portion for sandwiching a recording medium.

* * * * *